US011480142B2

(12) United States Patent
Galka et al.

(10) Patent No.: US 11,480,142 B2
(45) Date of Patent: Oct. 25, 2022

(54) IN-TANK FUEL SYSTEM COMPONENT RETENTION MEMBER

(71) Applicant: Walbro LLC, Cass City, MI (US)

(72) Inventors: William E. Galka, Caro, MI (US); Bryan K. Gangler, Unionville, MI (US); Bradley J. Roche, Millington, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 17/387,715

(22) Filed: Jul. 28, 2021

(65) Prior Publication Data

US 2022/0034285 A1 Feb. 3, 2022

Related U.S. Application Data

(60) Provisional application No. 63/058,719, filed on Jul. 30, 2020.

(51) Int. Cl.

| | |
|---|---|
| ***F02M 37/00*** | (2006.01) |
| ***F02M 37/50*** | (2019.01) |
| ***F02M 37/10*** | (2006.01) |
| ***F02M 37/42*** | (2019.01) |

(52) U.S. Cl.

CPC ..... *F02M 37/50* (2019.01); *F02M 37/0047* (2013.01); *F02M 37/0082* (2013.01); *F02M 37/10* (2013.01); *F02M 37/42* (2019.01); *F02M 2200/8061* (2013.01)

(58) Field of Classification Search

CPC ..... F02M 37/0017; F02M 37/0047; F02M 37/0076; F02M 37/0082; F02M 37/42; F02M 37/50; F02M 2200/8061

USPC ..... 123/469, 497, 509

See application file for complete search history.

(56) References Cited

U.S. PATENT DOCUMENTS

| | | | | |
|---|---|---|---|---|
| 4,874,510 | A * | 10/1989 | Akira | F02M 37/50 210/462 |
| 5,951,050 | A * | 9/1999 | Siekmann | F02M 37/103 280/830 |
| 8,372,278 | B1 | 2/2013 | Nguyen et al. | |
| 8,397,698 | B2 * | 3/2013 | Sharp | F02M 37/103 123/509 |
| 10,359,015 | B2 * | 7/2019 | Pinault | B60K 15/061 |
| 2001/0001963 | A1 * | 5/2001 | Murakoshi | F02M 37/103 137/565.34 |
| 2007/0144495 | A1 * | 6/2007 | Teets | F02M 37/04 123/509 |
| 2009/0200429 | A1 * | 8/2009 | Guptaa | F02M 37/0017 244/172.3 |
| 2009/0229580 | A1 * | 9/2009 | Kopinsky | B60K 15/03504 123/519 |
| 2016/0025050 | A1 * | 1/2016 | Salsburey | F02M 37/44 210/232 |

(Continued)

*Primary Examiner* — Erick R Solis

(74) *Attorney, Agent, or Firm* — Reising Ethington P.C.; Matthew J. Schmidt

(57) ABSTRACT

In at least some implementations, a device includes a fuel system component having a body through which fuel flows, and a retention member body connected to the body of the fuel system component, the retention member body having one or more retainers that are flexible and resilient, and that extend outwardly from the retention member body and that are arranged to engaged spaced apart portions of an interior of a fuel tank to retain the position in the fuel tank of the fuel system component.

21 Claims, 9 Drawing Sheets

(56) References Cited

U.S. PATENT DOCUMENTS

2018/0290539 A1 10/2018 Tipton et al.

* cited by examiner

IN-TANK FUEL SYSTEM COMPONENT RETENTION MEMBER

REFERENCE TO RELATED APPLICATIONS

This application claims the benefit of U.S. Provisional Application Ser. No. 63/058,719 filed on Jul. 30, 2020 the entire content of which is incorporated herein by reference in its entirety.

TECHNICAL FIELD

The present disclosure relates generally to a retention member to retain a fuel system component in position within a fuel tank.

BACKGROUND

Fuel tanks may include multiple fuel pickup devices positioned in different areas of a fuel tank to facilitate taking in fuel by and to a fuel pump from the different areas of the tank. The multiple fuel pickup devices can reduce the instances in which fuel is not available to the fuel pump due to sloshing or other movement in the fuel as a device with an engine moves during use. It can be difficult to ensure that the fuel pickup devices remain on or near a bottom of the fuel tank, especially in areas of a fuel tank remote from an access opening in the tank, through which the pickup devices are inserted into the tank.

SUMMARY

In at least some implementations, a retention member for an in-tank fuel system component, includes a retention member body having one or more retainers that are flexible and resilient, and that extend outwardly from the retention member body and that are arranged to engaged spaced apart portions of an interior of a fuel tank.

In at least some implementations, a connection feature of the retention member body is adapted to be snap-fit to a fuel system component to retain the retention member on the fuel system component.

In at least some implementations, the one or more retainers are flexible rods, a strip of flexible material having a length and a width greater than a thickness of the strip, a mesh body adapted to conform to a surface of a fuel tank, a flexible woven body adapted to conform to a surface of a fuel tank, or a foam body adapted to conform to a surface of a fuel tank. In at least some implementations, the one or more retainers includes a body adapted to resiliently deform against a surface of a fuel tank and thereby provide a force on a component to which the one or more retainers are connected. In at least some implementations, each of the one or more retainers is constructed to engage the fuel tank over a surface area of one square inch or greater.

In at least some implementations, the retention member body is adapted for connection to a pickup body or a filter.

In at least some implementations, multiple retainers are provided and at least two retainers are arranged to engage portions of a fuel tank that are not parallel to each other.

In at least some implementations, the retention member body includes a base and spaced apart arms extending from the base, each of the spaced apart arms includes a finger that extends inwardly so that a distance between inner surfaces of two fingers is less than the distance between inner surfaces of the arms including the two fingers. In at least some implementations, the retention member body includes a base and the one or more retainers are connected at one end to the base and each extends to a free end spaced from the base, the one or more retainers being spaced apart from each other.

In at least some implementations, the retention member body includes an opening adapted to receive a component to which the retention member body is connected. In at least some implementations, the retention member body is tubular.

In at least some implementations, the retention member body includes a base and the one or more retainers are connected at one end to the base and the one or more retainers are also connected to a cross member at a location on the one or more retainers that is spaced from the base.

In at least some implementations, a device includes a fuel system component having a body through which fuel flows, and a retention member body connected to the body of the fuel system component, the retention member body having one or more retainers that are flexible and resilient, and that extend outwardly from the retention member body and that are arranged to engaged spaced apart portions of an interior of a fuel tank to retain the position in the fuel tank of the fuel system component.

In at least some implementations, the fuel system component is one or both of a fuel pickup and a fuel filter.

In at least some implementations, the retention member body is a separate component from the fuel system component and is connected to the fuel system component by a connector of the retention member body.

In at least some implementations, the fuel system component includes a tubular outlet and the connector includes an opening in which at least part of the tubular outlet is received.

In at least some implementations, the fuel system component is a fuel pickup having a pickup body with a pair of feet and an open area between the pair of feet, and the retention member body includes at least one arm with a finger received in the open area to connect the retention member body to the pickup body.

In at least some implementations, the one or more retainers are flexible rods, a strip of flexible material having a length and a width greater than a thickness of the strip, a mesh body adapted to conform to a surface of a fuel tank, a flexible woven body adapted to conform to a surface of a fuel tank, or a foam body adapted to conform to a surface of a fuel tank. In at least some implementations, the one or more retainers includes a body adapted to resiliently deform against a surface of a fuel tank and thereby provide a force on a component to which the one or more retainers are connected. In at least some implementations, each of the one or more retainers is constructed to engage the fuel tank over a surface area of one square inch or greater.

In at least some implementations, the retention member body includes a base and the one or more retainers are connected at one end to the base and each extends to a free end spaced from the base, the one or more retainers being spaced apart from each other.

BRIEF DESCRIPTION OF THE DRAWINGS

The following detailed description of certain embodiments and best mode will be set forth with reference to the accompanying drawings, in which.

DETAILED DESCRIPTION

Figure 32:
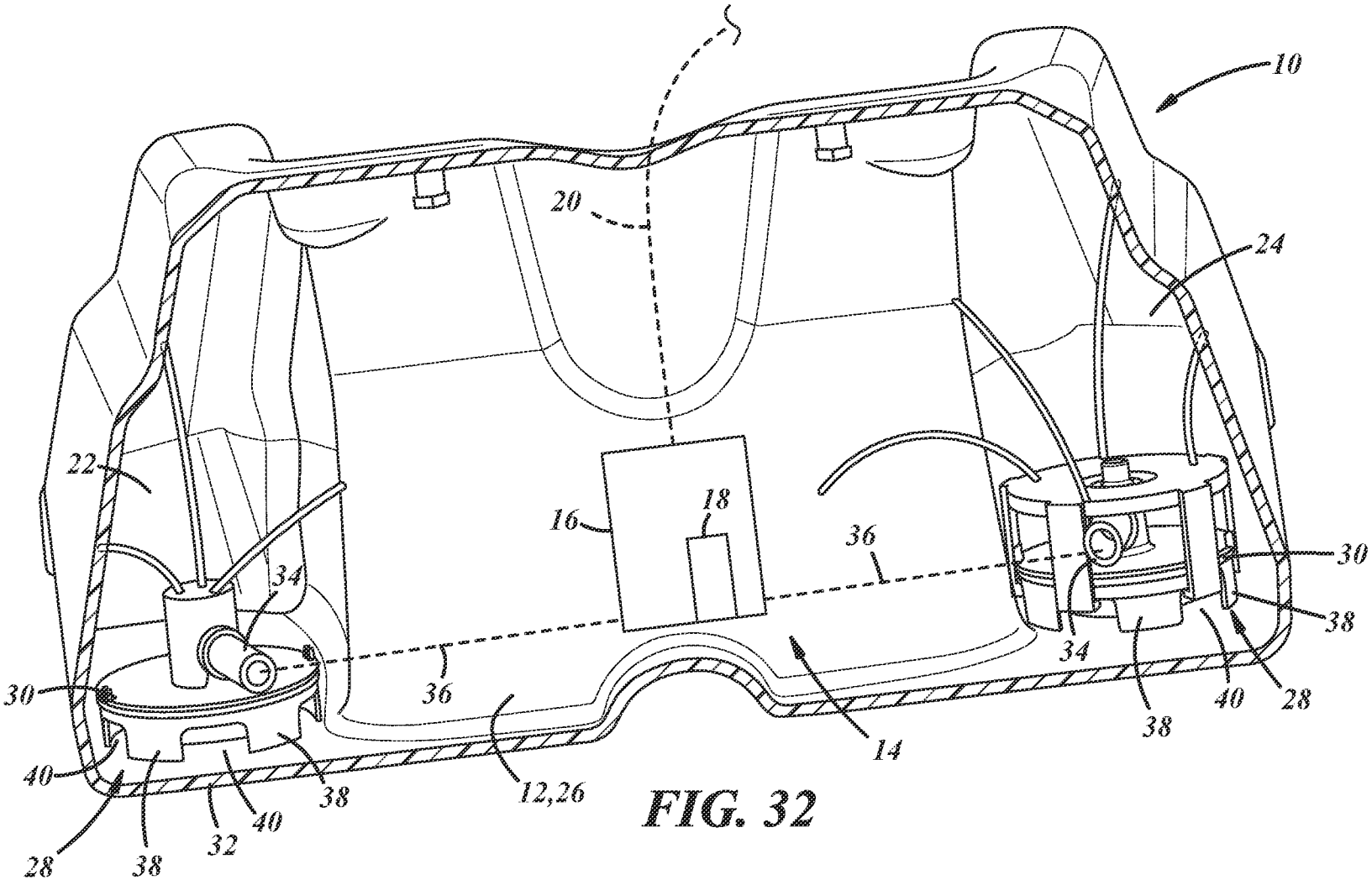
FIG. 32 shows a fuel tank including a fuel pump assembly in the fuel tank, and two pickups each including retention members with retainers engaged with the fuel tank.

Referring in more detail to the drawings, FIG. 32 illustrates a fuel tank 10 having an interior 12 in which a supply of fuel is retained and a fuel pump assembly 14 received in the interior 12 of the fuel tank 10. The fuel pump assembly 14 may include a canister 16 and a fuel pump 18 within the canister. The canister 16 may hold a supply of fuel separate from the fuel tank interior 12 and readily available to the fuel pump 18 to provide a more constant supply of fuel to the fuel pump. The fuel pump 18 increases the pressure of the fuel and discharges fuel through an outlet and corresponding fuel line 20 for delivery to an engine. The fuel pump 18 may have a pumping element (e.g. gerotor, gears, impeller, etc) driven by an electric motor as is known in the art.

The fuel tank 10 may have chambers 22, 24 or areas spaced from an area 26 in which the fuel pump assembly 14 is received, and these areas may be at different heights (relative to gravity and defining a sump or the like) or separated by internal walls or surfaces of the fuel tank 10. When the fuel tank 10 is tilted or due to accelerations of a vehicle including the fuel tank, fuel may flow toward one or more of these areas 22, 24 and away from the fuel pump assembly 14. To move fuel from these areas 22, 24 to the fuel pump assembly 14, one or more pickups 28 may be provided. The pickups 28 have bodies 30 with inlets adjacent to a bottom 32 of the fuel tank 10 (e.g. an interior surface of a wall defining a bottom of the fuel tank) and outlets 34 connected to the fuel pump assembly 14 by suitable conduits 36. A low pressure source may be communicated with the outlets 34 via the conduits 36 to draw fuel through the pickups and to the fuel pump assembly 14. The low pressure source may be the fuel pump, or a different electric motor driven fuel pump or a fluid driven fuel pump including a venturi the flow of fuel through which creates a pressure drop, as is known in the art. The fluid driven pump may be provided with a portion of the fuel discharged from the fuel pump 18 of the fuel pump assembly 14, in at least some implementations.

Figure 1:
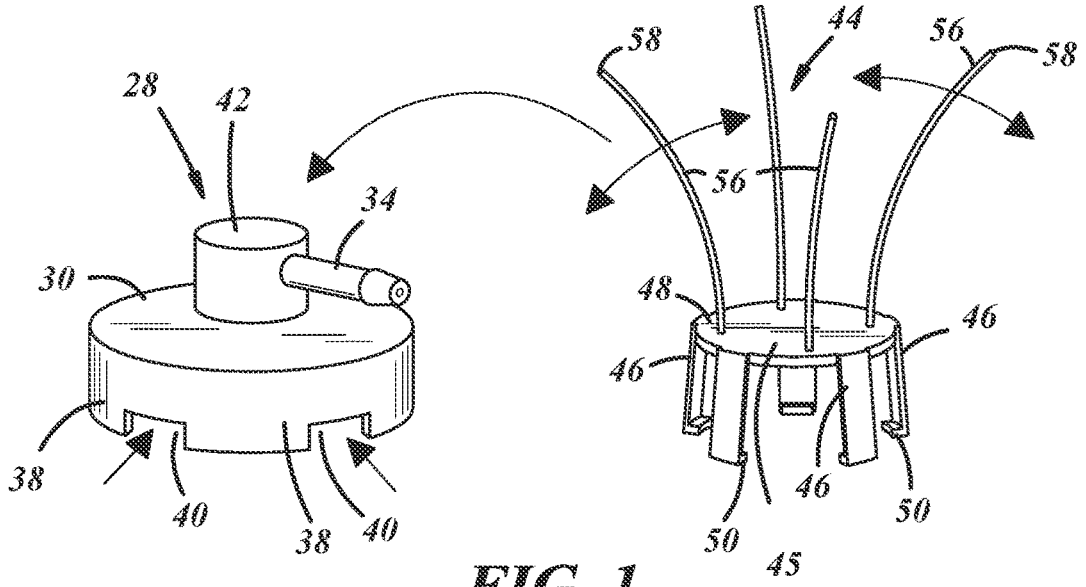
FIG. 1 is an exploded view of a pickup and retention member.

Each pickup body 30 may be formed from plastic or other suitable material, and may include one or more feet 38 adapted to rest on/engage the bottom wall 32 of the fuel tank 10. Open areas 40 between or adjacent to the foot/feet 38 are provided to enable fuel to flow into the pickup inlet for delivery out of the outlet 34 and into the fuel conduit 36 connected to the outlet. As shown in FIG. 1, the pickup body 30 includes multiple feet 38 with open areas 40 between adjacent feet for fuel flow between the feet. The outlet 34 may be defined by a spigot, nipple or tube extending from a boss 42 of the pickup body 30, where the boss 42 and spigot 34 communicate with the inlet of the pickup 28. The fuel conduit 36 may be press-fit to the spigot 34 and retained by friction or a mechanical coupler (e.g. a hose clamp).

The pickups 28 may be received in different areas of the fuel tank 10 without directly fixing the pickup bodies 30 in place or directly coupling them to the fuel tank 10. Even if somewhat rigid fuel conduits 36 are coupled to the pickups 28, the pickups may move when positioned within a fuel tank 10, and such movement can negatively impact the ability of the pickup to move fuel from the lowest areas of the fuel tank.

Figure 2:
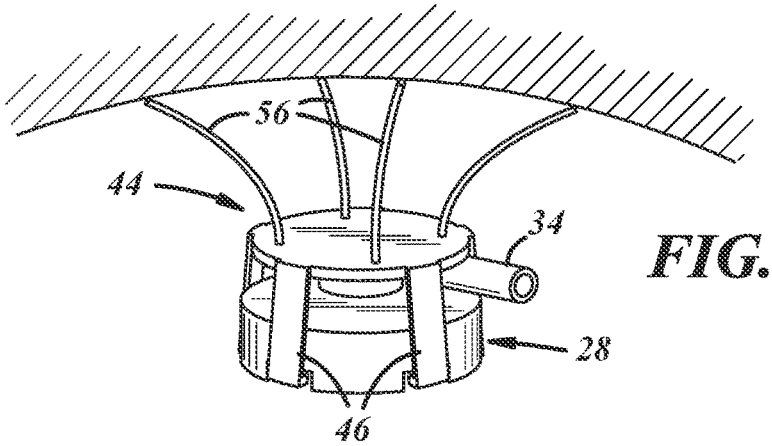
FIG. 2 is a perspective view showing the retention member assembled onto the pickup.

As shown in FIGS. 1 and 2, to reduce or prevent movement of a pickup 28 from an installed position within the fuel tank 10, one or more retention members 44 are provided on or connected to the pickup 28. In the illustrated example of FIGS. 1 and 2, the retention members 44 are formed separately from the body 30 of the pickup 28, but in other embodiments, the retention member(s) may be formed integrally with the pickup body (e.g. molded as a single piece of plastic). When formed separately, the retention members 44 are connected to the pickup body 30 by a connection feature so that the retention members remain in position relative to the pickup body in use. The connection may be done in any suitable way including by mechanical fastener (e.g. screw, clip or bolt), weld, adhesive, interference or press-fit, or by snap-fit with overlapping retainers.

Figure 6:
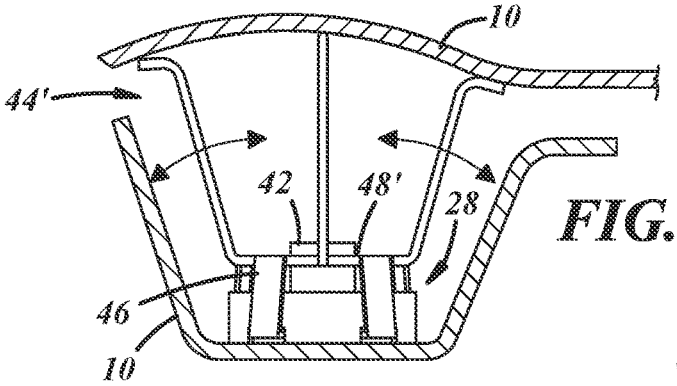
FIG. 6 is a side sectional view of a retention member on a pickup and including retainers engaged with the fuel tank.
Figure 7:
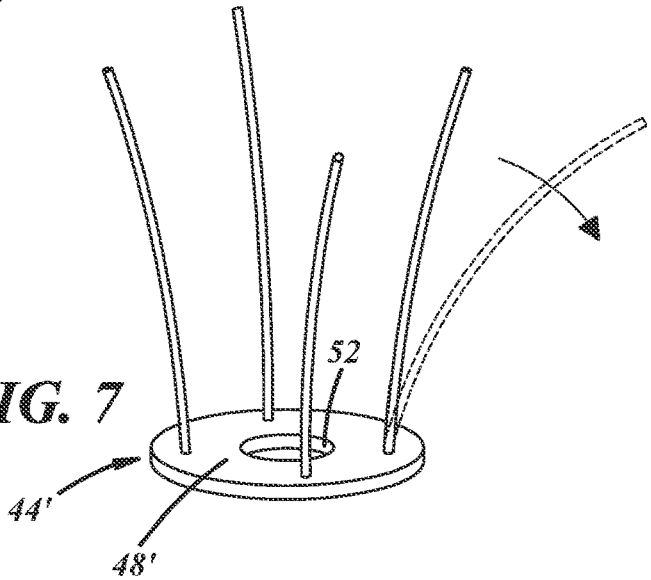
FIG. 7 is a perspective view of the retention member of FIG. 6.
Figure 8:
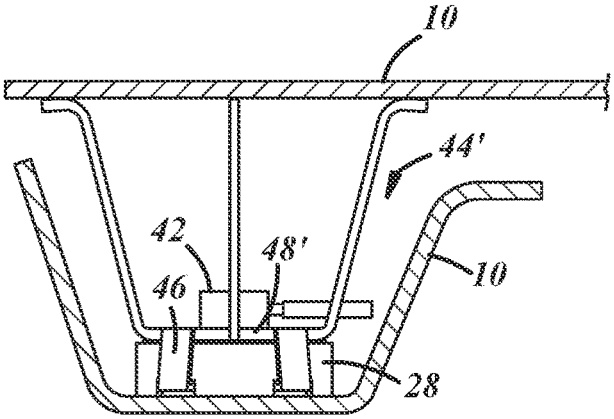
FIG. 8 is another side sectional view of the retention member and pickup of FIG. 6.
Figure 24:
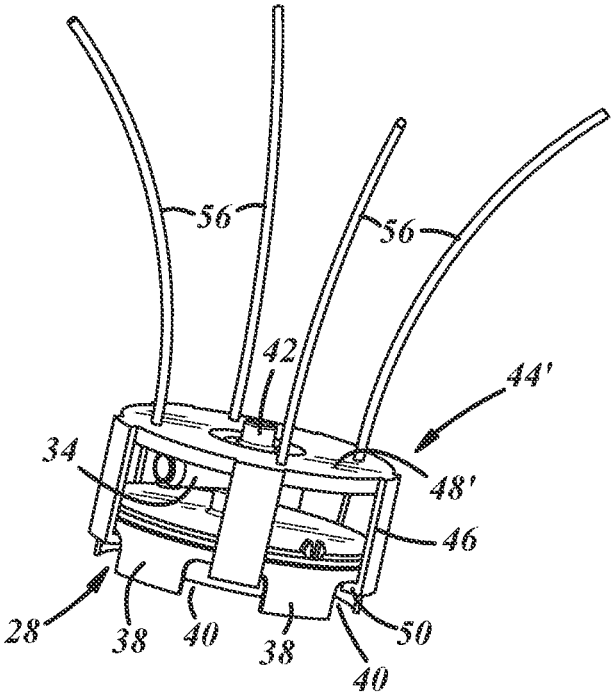
FIGS. 24 and 25 show the retention member of FIG. 23 coupled to a pickup, with FIG. 25 showing the coupled components received within a fuel tank.
Figure 25:
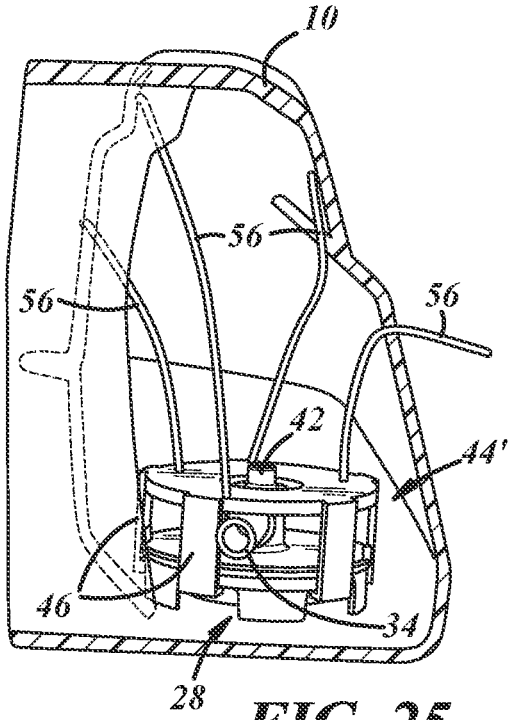

The retention member 44 of FIGS. 1 and 2 has a body 45 with a connection feature defined by spaced apart arms 46 extending from a base 48. The arms 46 include inwardly extending fingers 50 that are arranged to be received in the open areas 40 between feet 38 of the pickup body 30, with the arms 46 received outboard of the pickup body 30 and the fingers 50 extending inwardly in the open areas 40 and overlapping the pickup body 30. A distance between inner surfaces of the fingers 50 is less than a corresponding dimension of the pickup body 30. Thus, when the retention member 44 is pressed onto the pickup body 30, the fingers 50 engage the outer surface of the pickup body, and the arms 46 must flex to permit the fingers to slide over the pickup body. When the fingers 50 are aligned with the open areas 40, the arms 46 return to or toward their unflexed positions and the fingers 50 are overlapped with the pickup body 30 to securely connect the retention member 44 to the pickup 28, as shown in FIGS. 2, 24 and 25. The base 48 may overlie the boss 42 and outlet 34 of the pickup body 34, or, as shown in FIGS. 6-8, the base 48' of a modified retention member 44' may include a void 52 through which part or all of these features (e.g. part of the boss as shown in these figures) extend in assembly. The fingers 46 may include inwardly extending stop surfaces 54 that oppose removal of the retention member 44 from the pickup body 30 in a direction opposite to the installation direction. The stop surfaces 54 may be perpendicular to, or within 20 degrees of perpendicular to, the installation direction. While multiple fingers 46 are shown, a single finger could be used and have a flexible stop surface that is compressed when pushed through a void in the pickup body and expands when fully through the void to inhibit removal from the void. Multiple fingers could have such stop surfaces, each pressed into and through a separate void, if desired.

Figure 4:
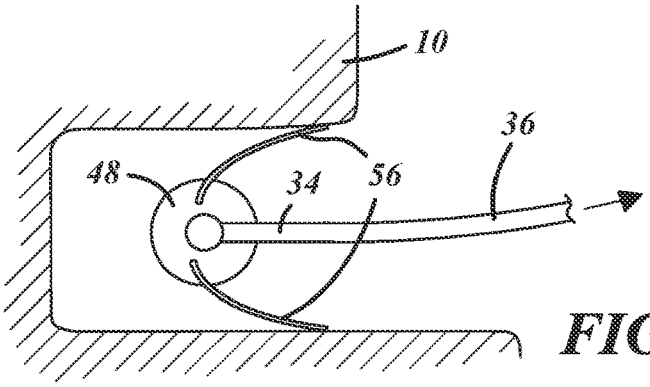
FIG. 4 is a fragmentary sectional view showing retainers engaged with side surfaces of a fuel tank.
Figure 5:
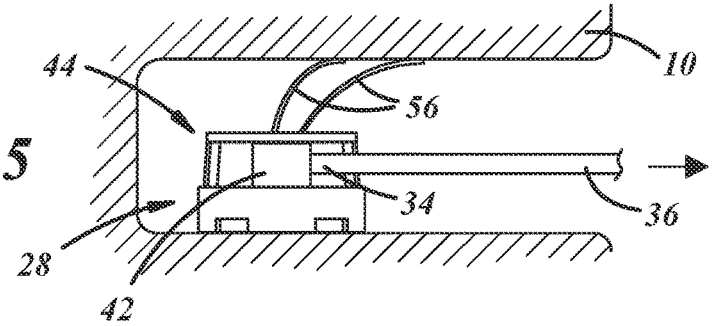
FIG. 5 is a fragmentary sectional view showing retainers engaged with a downwardly facing surface of the fuel tank (e.g. an upper surface of the fuel tank)
Figure 22:
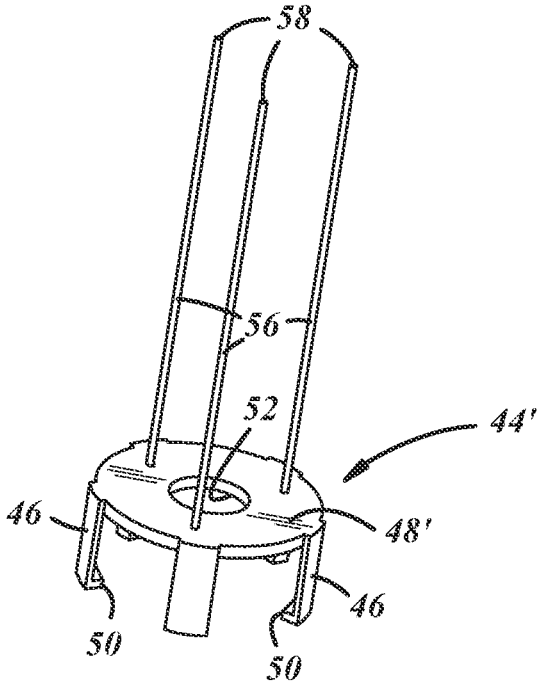
FIGS. 22 and 23 show retention members having straight or curved retainers.
Figure 23:
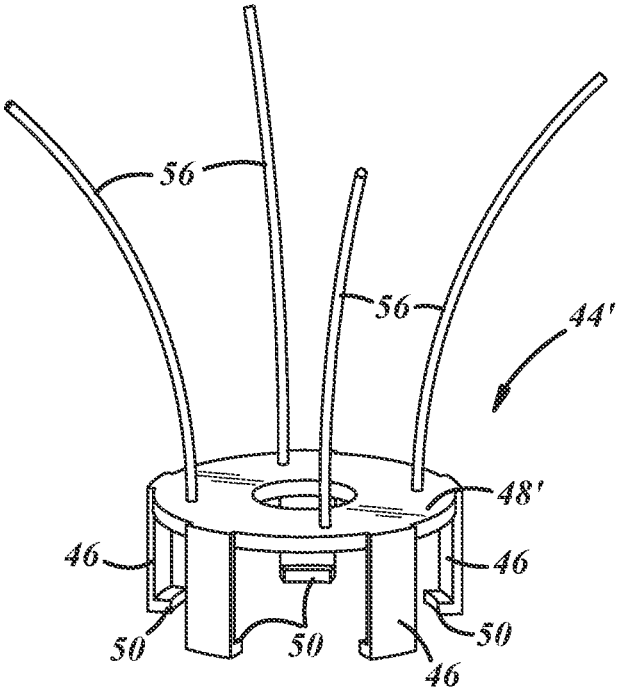

To retain the pickup body 30 in position within the fuel tank 10, the retention member 44 (and 44') includes one or more retainers 56 that extend outwardly from the retention member body 45 to a free end 58. The retainers 56 may be flexible and resilient and are designed to engage the fuel tank 10 at a location spaced from the engagement of the pickup body 30 with the fuel tank 10 (e.g. where the feet 38 engage the tank 10), as shown in FIGS. 4, 5 and 25. With multiple retainers 56 engaging the fuel tank 10 at different, spaced apart positions, forces are provided from multiple directions to oppose movement of the pickup 28 relative to the fuel tank 28. In some implementations, multiple retainers 46 are provided with some arranged to engage an inside side surface of the fuel tank (e.g. as shown in FIG. 4) and some arranged to engage downwardly (relative to and in the direction of gravity) facing surface of the tank (e.g. as shown in FIG. 5) to provide a downward force on the pickup 28 to hold the pickup against the bottom of the fuel tank 10. In the examples of FIGS. 1, 2, 4-8, and 22-25, the retainers 46 are elongated, thin, flexible projections or rods that extend from spaced apart locations of the base 48. The rods 46 may be straight as shown in FIG. 22, which shows three rods 46, or curved or bent as shown in FIG. 23 which shows four rods 46. While shown extending from the base 48, retainers 46 may also or instead extend from one or more fingers 46 of the retention member 44.

Figure 3:
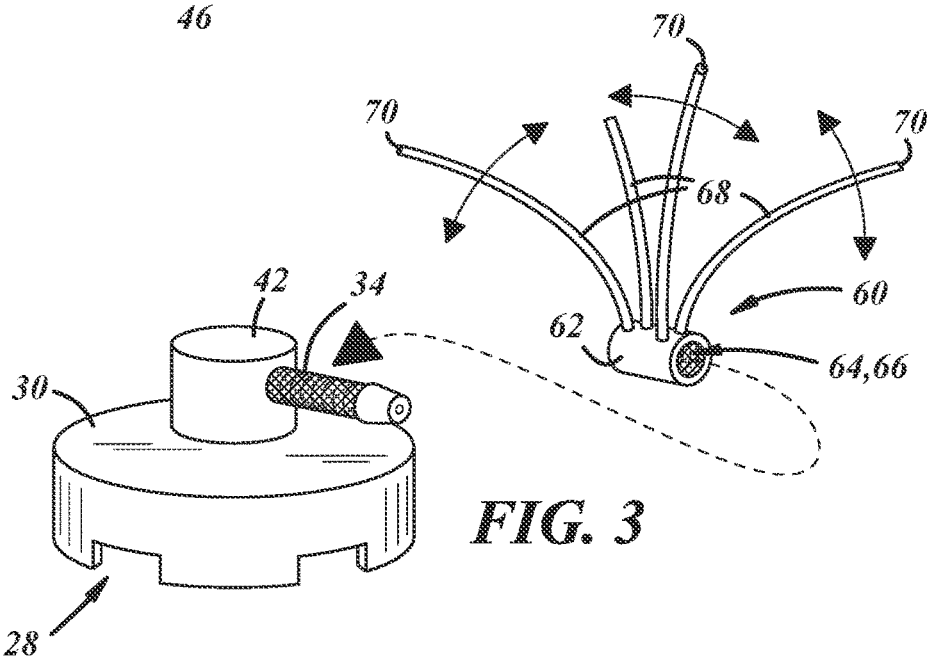
FIG. 3 is an exploded view of an alternate retention member and pickup.
Figure 29:
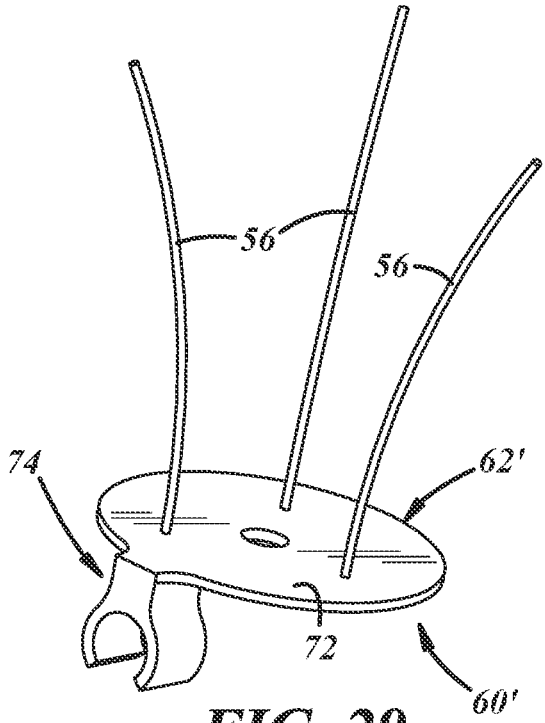
FIGS. 29-31 show a retention member adapted to be coupled to a spigot of a pickup, with FIG. 30 showing the retention member on a pickup and FIG. 31 showing the retention member and pickup within a fuel tank.
Figure 30:
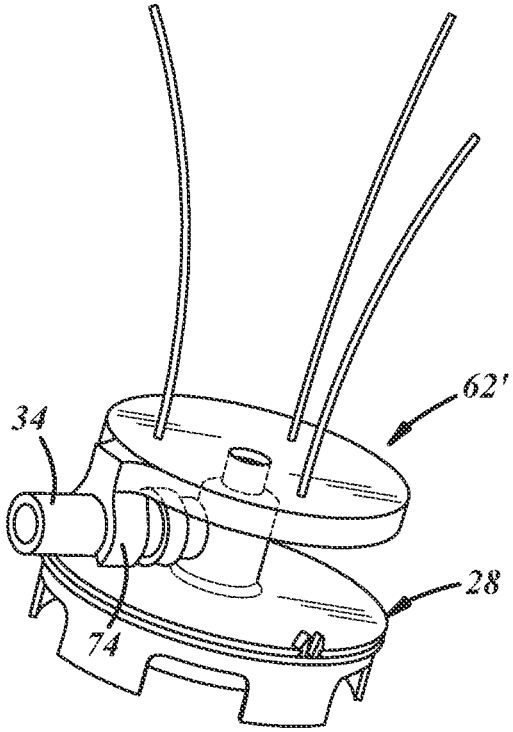
Figure 31:
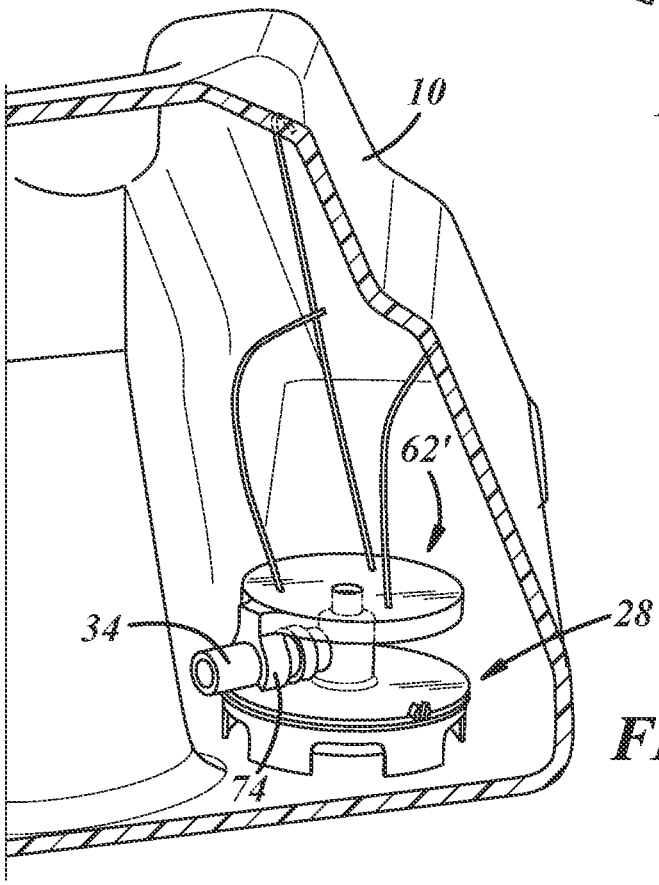

FIG. 3 shows a retention member 60 having a body 62 with a connection feature 64 designed to be snap fit over the spigot 34 of the pickup body 30. The retention member body 62 is complementary in shape to the exterior surface of the spigot 34 and the connection feature includes an opening 66 that is smaller than a diameter (or maximum dimension/width of the spigot) of the spigot 34 such that the body 62 flexes to expand the opening 66 when pressed onto the spigot 34, and then the body 62 resiliently contracts to reduce the size of the opening 66 to overlap the spigot 34 and retain the body 62 on the spigot 34. The retention member 60 also includes one or more retainers 68 extending from the body 62 to a free end 70 spaced from the body 62, and which may be constructed as described above to engage different areas of the fuel tank 10. FIGS. 29-31 show a similar retention member 60' having a body 62' with a base 72 that overlies the boss 42 and a majority of the pickup body 30, and a connector a 74 extending from the base 72 and arranged to be snap-fit over the exterior surface of the spigot, as shown in FIG. 30, to retain the retention member 60' to the pickup body 30. The retention member body 62' may include flexible and resilient retainers 56 arranged to engage surfaces of the fuel tank to inhibit movement of the pickup relative to the fuel tank, as generally shown in FIG. 31. The retainers 56 may be formed in any desired manner including the forms mentioned above and/or below.

Figure 9:
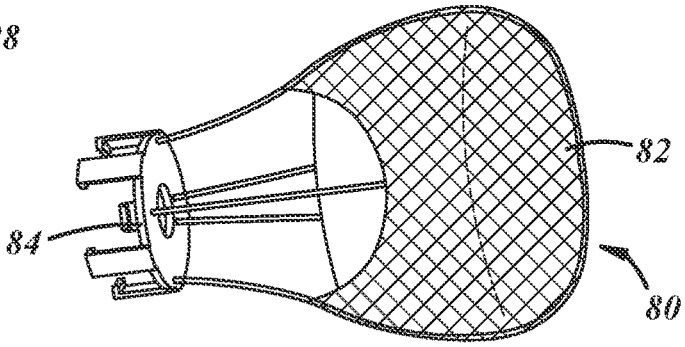
FIG. 9 is a side view of a retention member with a mesh retainer.
Figure 13:
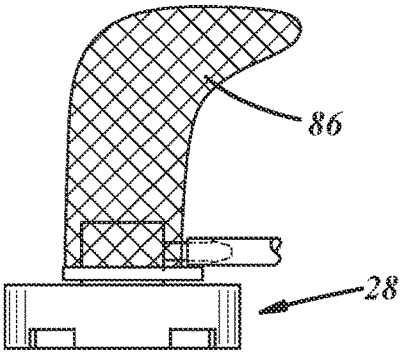
FIG. 13 shows a retention member coupled to a pickup and having a mesh or foam retainer.
Figure 14:
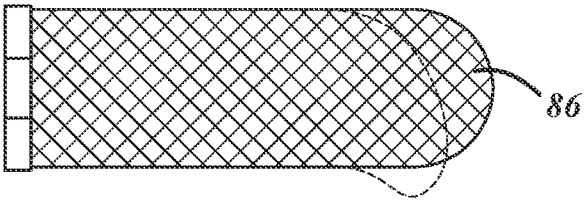
FIG. 14 shows the retainer of the retention member of FIG. 13.

FIG. 9 shows a retention member 80 with a closed or open weave mesh retainer 82 extending from a body 84 of the retention member 80. The body may be constructed like the body in FIG. 1, the body in FIG. 29 or otherwise, for connection to the pickup 28. The retainer 82 engages the fuel tank 10 over a larger surface area than any one of the retainers 56 in the already described embodiments, and the retainer 82 resiliently conforms to a surface of the fuel tank 10 and flexes to provide a force on the pickup that inhibits movement of the pickup relative to the fuel tank. FIGS. 13 and 14 show a foam (closed or open cell) retainer 86 that is flexible to conform to the shape of the fuel tank surface against which it is engaged, and is resilient to provide a force on the pickup 28 to inhibit movement of the pickup relative to the fuel tank 10. The woven or foam retainers 82, 86 may engage the fuel tank over a surface area of one square inch or greater, in at least some implementations.

Figure 10:
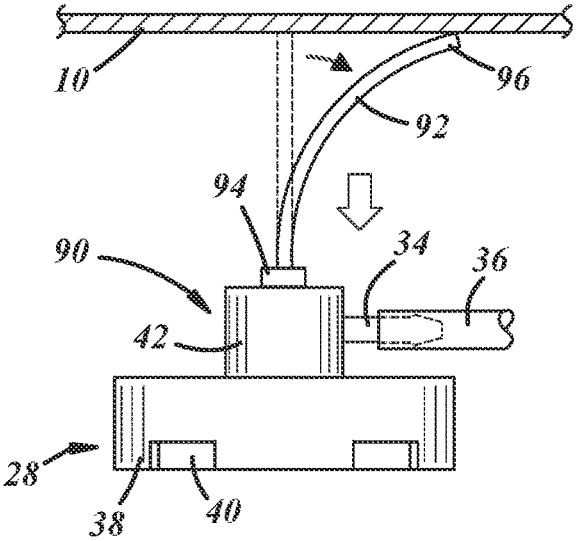
FIGS. 10 and 11 show a retainer coupled to a boss of a pickup and having a strip-shaped retainer.
Figure 11:
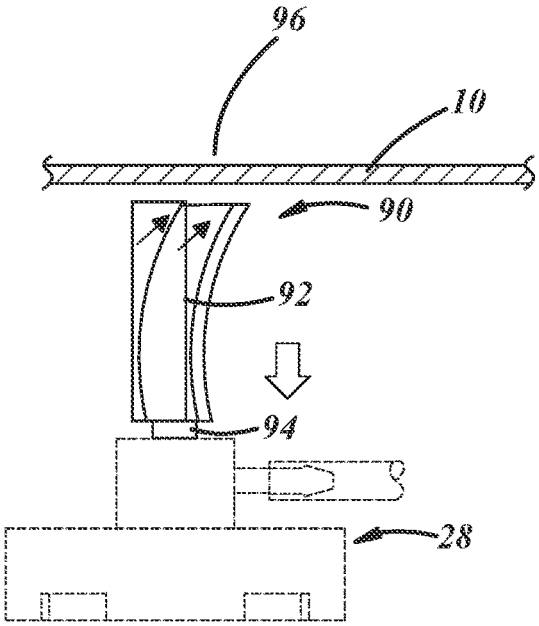

FIGS. 10 and 11 shown a retention member 90 with a flexible strip-shaped retainer 92 extending from a base 94 to a free end 96. The strip retainer 92 has a length (between the base 94 and free end 96) suitable to enable the retainer 92 to engage a surface of the fuel tank 10, a thickness and a width greater than the thickness. The strip retainer 92 may engage the fuel tank 10 over a greater area than the thin rod retainers 56 previously described, and may act in similar manner to inhibit movement of the pickup 28 relative to the fuel tank 10.

Figure 12:
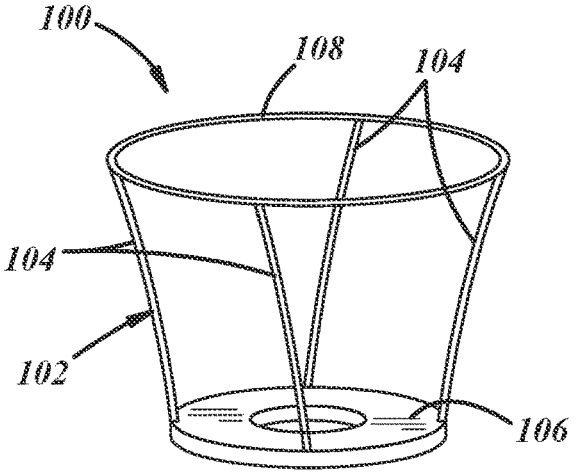
FIG. 12 shows a retention member with retainers coupled together.

FIG. 12 shows a retaining member 100 having a retainer 102 comprised of spaced apart, thin, rods 104 that are connected at a location spaced from the base 106 (e.g. at the free ends of the rods, or between the base and free ends) by a cross member 108. The cross member reduces the range of movement of the rods relative to each other and so the rods and cross member function as a unit to retain the position of the pickup relative to the fuel tank.

Figure 15:
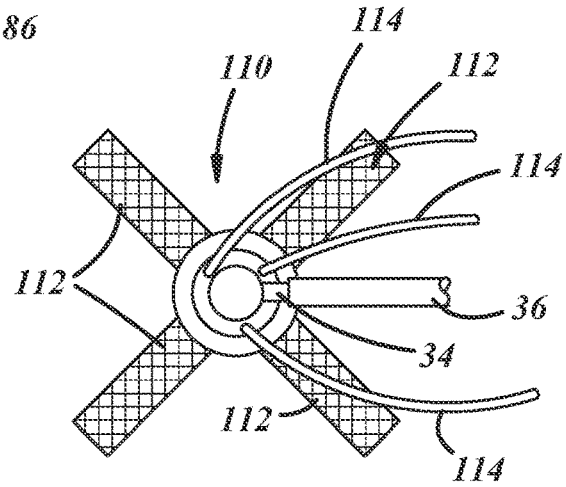
FIG. 15 shows a retention member with multiple outwardly extending mesh or foam sock elements and outwardly extending rod retainers.

FIG. 15 shows a retention member 110 having a retainer or retainers defined by a plurality of outwardly extending sock elements 112 (e.g. of mesh or foam) to engage side surfaces of the fuel tank 10 and one or more upwardly extending flexible rods 114 to engage top or other downwardly facing surfaces of the fuel tank 10.

Figure 16:
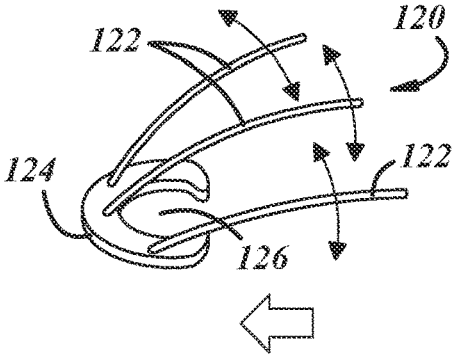
FIG. 16 shows a retention member with a C-shaped body arranged for snap-fit to a pickup or filter.
Figure 17:
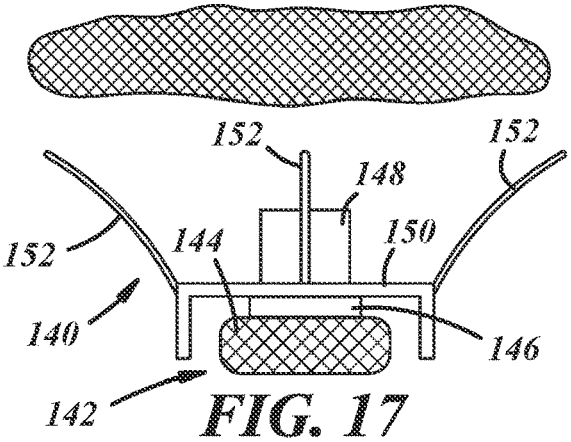
FIGS. 17-20 show a retention member for a filter.
Figure 18:
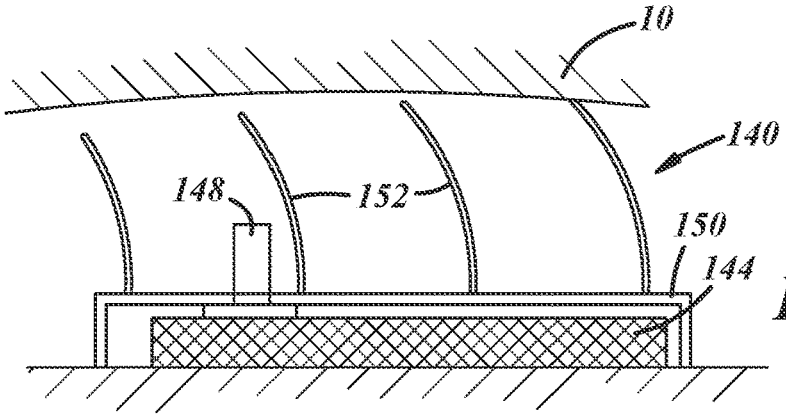
Figure 19:
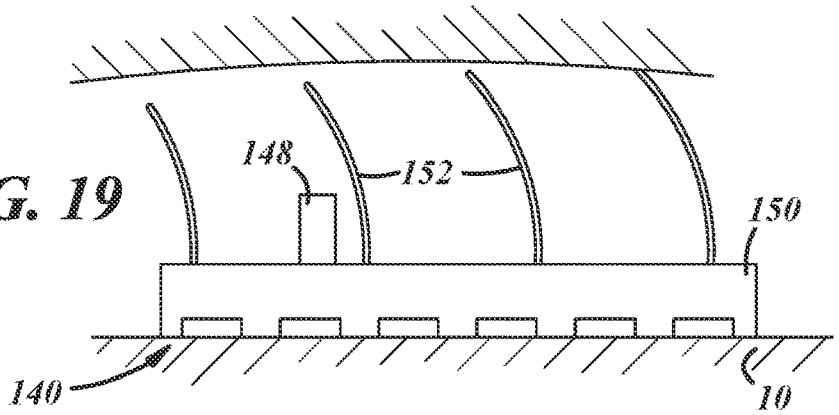
Figure 20:
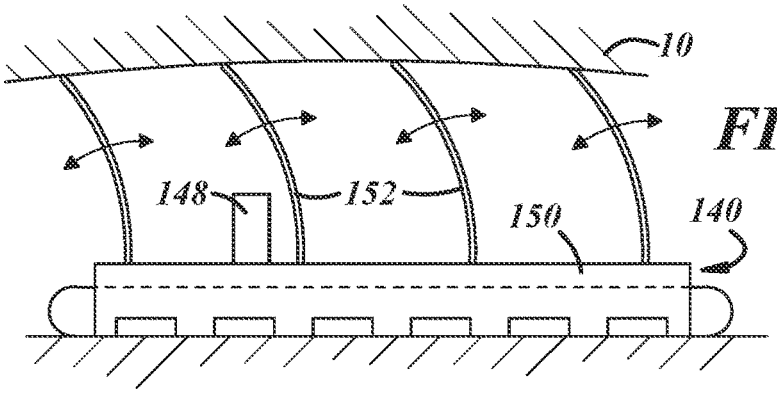

FIG. 16 shows a retention member 120 with one or more retainers defined by flexible rods 122 extending from a C-shaped base 124 with a slot or opening 126 that may be snap-fit to a cylindrical part of the pickup body 30, such as the boss 42 or spigot 34.

Figure 26:
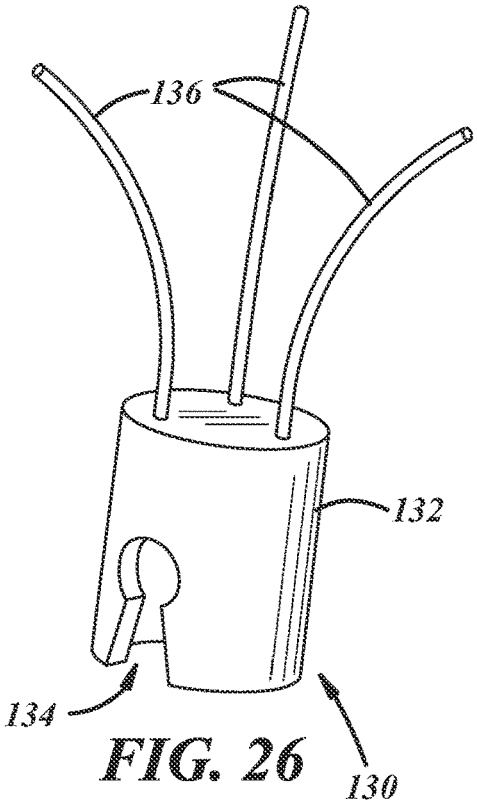
FIGS. 26-28 show a retention member adapted to be fitted over a boss and spigot of a pickup, with FIG. 27 showing the retention member on a pickup and FIG. 28 showing the retention member and pickup within a fuel tank.
Figure 27:
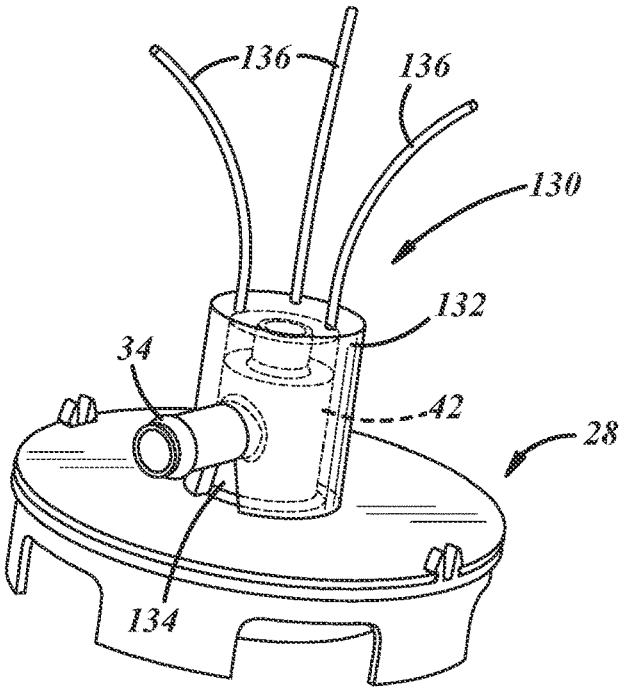
Figure 28:
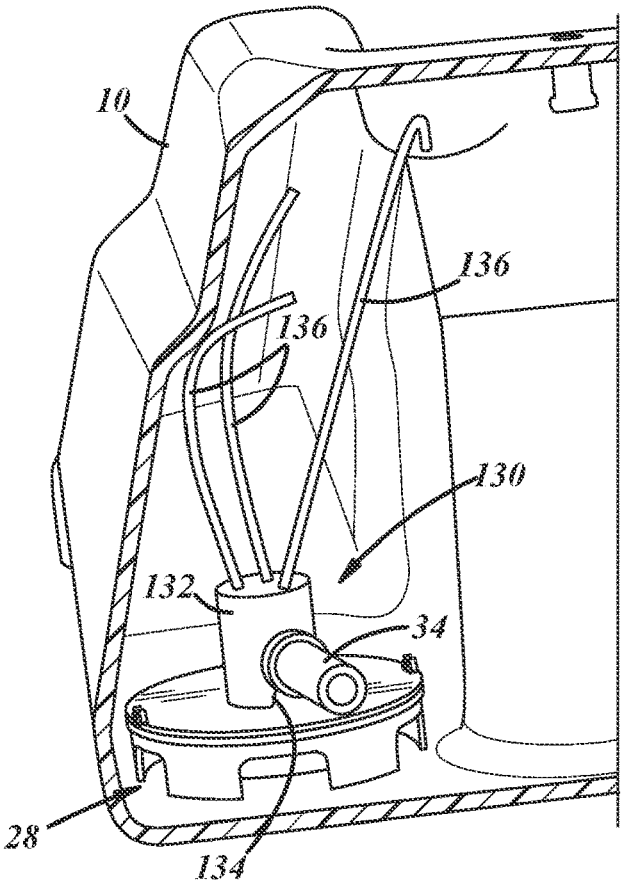

FIGS. 26-28 show a retention member 130 having a body 132 that is adapted to be received at least partially over the boss 42 of a pickup body 30, and to be snap fit over the exterior surface of the spigot 34 or outlet tube of the pickup body. The retention member body 132 has a slot 134 with a portion having a size less than the diameter of the spigot 34, and the retention member body 132 flexes when pressed over the spigot 34, and resiliently returns to or toward its unflexed state when installed to overlap the spigot 34 and inhibit removal of the retention member 130 from the pickup 28. The retention member body may include one or more flexible and resilient retainers 136 arranged to engage surfaces of the fuel tank 10 to inhibit movement of the pickup 28 relative to the fuel tank. The retainers 136 may be formed in any desired manner including the forms mentioned above. FIG. 27 shows the retention member body 132 received over the boss 42 of the pickup body 30, with the spigot 34 extending through the slot 134. FIG. 28 shows the retention member 130 assembled to the pickup 28 with those components in position within a fuel tank 10, and with the retainers 136 engaging surfaces of the fuel tank 10.

Figure 21:
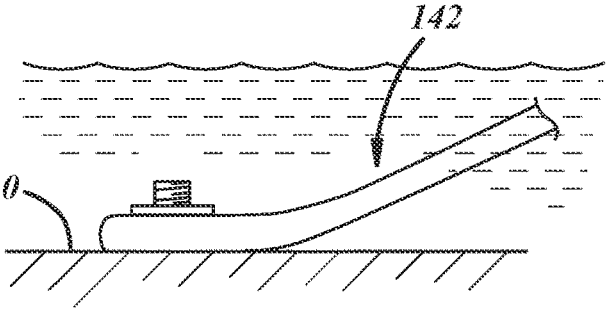
(Prior Art) FIG. 21
FIG. 21 shows a filter without a retention member according to the prior art.

FIGS. 17-20 show retention members 140 that may be used to retain the position and/or shape of a filter 142 which may be coupled to the fuel pump assembly 14 or to a pickup body 30. The filter 142, as shown in FIG. 21 may have a filter element 144 that encloses an interior of the filter. The filter element 144 may be formed from, for example, mesh or foam through which fuel flows to remove contaminants from the fuel. A body 146 of the filter 142 defines or has an outlet tube 148 communicated with the filter interior and through which fuel exits the filter 142. The filter element 144 may be flexible and, in use, may bend or twist relative to the filter body 146, which can reduce the effectiveness of the filter 142, e.g. by closing off part of the interior of the filter. As shown in FIG. 21, the filter element 144 may tend to float in fuel and create a bend, and potential kinked area of the filter element.

As shown in FIGS. 17-20, the retention member 140 may have a body 150 with a shape generally complementary to the filter element 144 and may be received over part of, and preferably at least a majority of the filter element 144, to inhibit movement of the filter element relative to the relative to the filter body 146. The retention member body 150 may be snap-fit or coupled to the filter 142 in any desired manner, including the manners described herein with respect to a pickup body 30. The retention member body 150 may include flexible and resilient retainers 152 arranged to engage surfaces of the fuel tank 10 to inhibit movement of the filter 142 relative to the fuel tank 10. The retainers 152 may be formed in any desired manner including the forms mentioned above with regard to the retention members coupled to a pickup. With a pickup that includes a filter for fuel entering the pickup inlet, the retention member 140 may both be received over the pickup body 30 and the filter element 144. That is, a single retention member 140 may both hold the filter element 144 in place and the pickup body 30 in place, as described herein.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A retention member for an in-tank fuel system component, comprising:

a fuel system component having a body through which fuel flows, the body of the fuel system component adapted to engage an interior of a fuel tank; and a retention member body having one or more retainers that are flexible and resilient, and that extend outwardly from the retention member body and that are arranged to engage an interior of the fuel tank at a location spaced from the location of engagement of the body of the fuel system component with the fuel tank.

2. The retention member of claim 1 which includes a connection feature adapted to be snap-fit to a fuel system component to retain the retention member on the fuel system component.

3. The retention member of claim 1 wherein the one or more retainers are flexible rods, a strip of flexible material having a length and a width greater than a thickness of the strip, a mesh body adapted to conform to a surface of a fuel tank, a flexible woven body adapted to conform to a surface of a fuel tank, or a foam body adapted to conform to a surface of a fuel tank.

4. The retention member of claim 1 which is adapted for connection to a pickup body or a filter.

5. A retention member for an in-tank fuel system component, comprising:

a retention member body having one or more retainers that are flexible and resilient, and that extend outwardly from the retention member body and that are arranged to engaged spaced apart portions of an interior of a fuel tank, wherein multiple retainers are provided and at least two retainers are arranged to engage portions of a fuel tank that are not parallel to each other.

6. The retention member of claim 1 wherein the retention member body includes a base and spaced apart arms extending from the base, each of the spaced apart arms includes a finger that extends inwardly so that a distance between inner surfaces of two fingers is less than the distance between inner surfaces of the arms including the two fingers.

7. The retention member of claim 1 wherein the retention member body includes a base and the one or more retainers are connected at one end to the base and each extends to a free end spaced from the base, the one or more retainers being spaced apart from each other.

8. The retention member of claim 1 wherein the retention member body includes an opening adapted to receive a component to which the retention member body is connected.

9. The retention member of claim 8 wherein the retention member body is tubular.

10. The retention member of claim 4 wherein the one or more retainers includes a body adapted to resiliently deform against a surface of a fuel tank and thereby provide a force on a component to which the one or more retainers are connected.

11. The retention member of claim 10 wherein each of the one or more retainers is constructed to engage the fuel tank over a surface area of one square inch or greater.

12. The retention member of claim 1 wherein the retention member body includes a base and the one or more retainers are connected at one end to the base and the one or more retainers are also connected to a cross member at a location on the one or more retainers that is spaced from the base.

13. A device, comprising:

a fuel system component having a body through which fuel flows, wherein the body includes at least one foot adapted to engage a bottom wall of a fuel tank; and a retention member body connected to the body of the fuel system component, the retention member body having one or more retainers that are flexible and resilient, and that extend outwardly from the retention member body and that are arranged to engage a downwardly facing portion of the fuel tank to provide a force on the body of the fuel system component to retain the at least one foot engaged with the bottom wall of the fuel tank.

14. The device of claim 13 wherein the fuel system component is one or both of a fuel pickup and a fuel filter.

15. The device of claim 13 wherein the retention member body is a separate component from the fuel system component and is connected to the fuel system component by a connector of the retention member body.

16. The device of claim 15 wherein the fuel system component includes a tubular outlet and the connector includes an opening in which at least part of the tubular outlet is received.

17. The device of claim 13 wherein the fuel system component is a fuel pickup having a pickup body with a pair of feet and an open area between the pair of feet, and the retention member body includes at least one arm with a finger received in the open area to connect the retention member body to the pickup body.

18. The device of claim 13 wherein the one or more retainers are flexible rods, a strip of flexible material having a length and a width greater than a thickness of the strip, a mesh body adapted to conform to a surface of a fuel tank, a flexible woven body adapted to conform to a surface of a fuel tank, or a foam body adapted to conform to a surface of a fuel tank.

19. The device of claim 13 wherein the retention member body includes a base and the one or more retainers are connected at one end to the base and each extends to a free end spaced from the base, the one or more retainers being spaced apart from each other.

20. The device of claim 18 wherein the one or more retainers includes a body adapted to resiliently deform against a surface of a fuel tank and thereby provide a force on a component to which the one or more retainers are connected.

21. The device of claim 18 wherein each of the one or more retainers is constructed to engage the fuel tank over a surface area of one square inch or greater.

* * * * *